US005155288A

United States Patent [19]

Marshall et al.

[11] Patent Number: 5,155,288

[45] Date of Patent: Oct. 13, 1992

[54] AIRCRAFT CONTROLLED LAUNCH CONTAINER FOR MULTIPLE STORES

[75] Inventors: Frank P. Marshall, Penns Park; Bruce W. Travor, Holland; James F. McEachern, Newtown, all of Pa.

[73] Assignee: The United States of America as represented by the Secretary of the Navy, Washington, D.C.

[21] Appl. No.: 761,197

[22] Filed: Aug. 20, 1991

Related U.S. Application Data

[63] Continuation-in-part of Ser. No. 590,875, Sep. 28, 1990, Pat. No. 5,092,221.

[51] Int. Cl.[5] ..... B64D 1/04

[52] U.S. Cl. ..... 89/1.510; 89/1.560

[58] Field of Search ..... 89/1.51, 1.56; 102/260, 102/261

[56] References Cited

U.S. PATENT DOCUMENTS

| | | | |
|---|---|---|---|
| 3,451,306 | 6/1969 | Lagerstrom et al. | 89/1.51 |
| 4,019,421 | 4/1977 | Ström | 89/1.51 |
| 4,026,188 | 5/1977 | Woodruff et al. | 89/1.51 |
| 4,164,887 | 8/1979 | Ouellette | 89/1.51 |
| 4,733,597 | 3/1988 | Upham | 89/1.51 |
| 5,052,270 | 10/1991 | Travor et al. | 89/1.51 |

*Primary Examiner*—David H. Brown

*Attorney, Agent, or Firm*—James V. Tura; James B. Bechtel; Susan E. Verona

[57] ABSTRACT

The disclosure shows a multi-store, electrically-operated sonobuoy launcher that is connected to the sonobuoy launcher power system of the aircraft. The sonobuoys are sequentially stacked inside the launcher and current switching and blocking means regulate and direct pulses from a switch in the aircraft to ensure individual, single sonobuoy launches.

4 Claims, 3 Drawing Sheets

FIG. 1
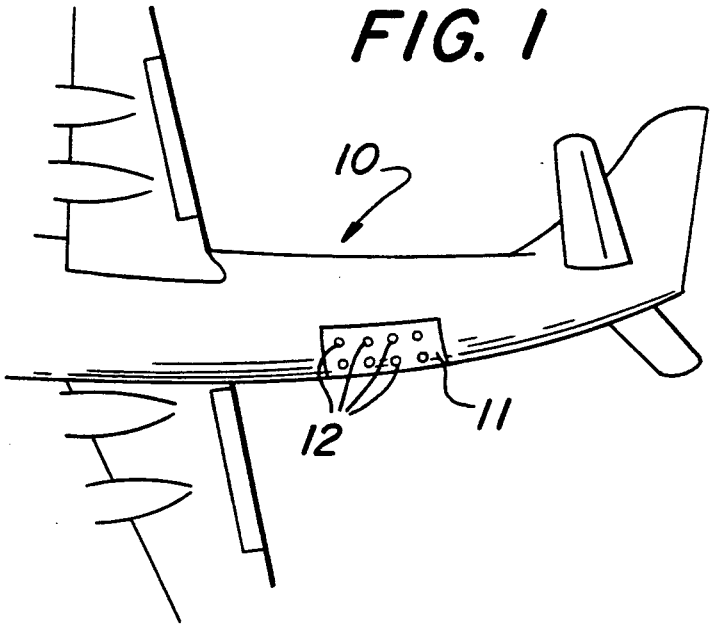
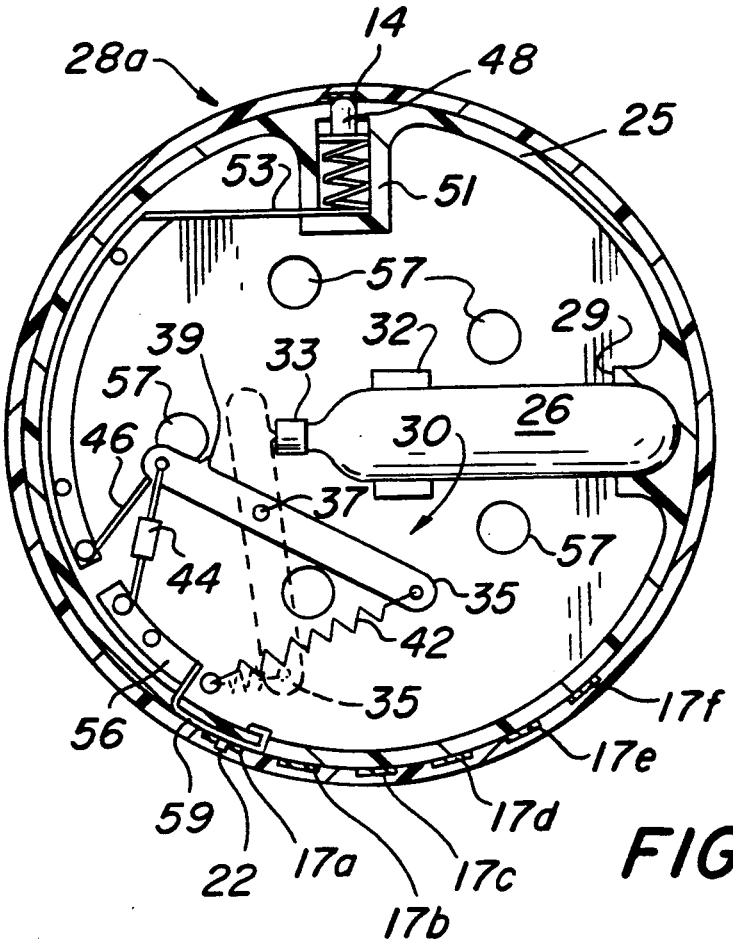
FIG. 3

AIRCRAFT CONTROLLED LAUNCH CONTAINER FOR MULTIPLE STORES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This application is a continuation-in-part (CIP) of application Ser. No. 590,875, filed Sep. 28, 1990, U.S. Pat. No. 5,092,221 dated Mar. 3, 1992, now entitled "Launch Container For Multiple Stores" and assigned to the U.S. Government.

There are instances where it is desirable to launch a multitude of stores, for instance sonobuoys, over a selected area and from a transporting aircraft. These two requirements, in turn, dictate numerous other conditions to be satisfied: construction, cooperation and size of the aircraft interface and the equipment holding the buoys; a means to energize this equipment and eject a buoy at the proper time and speed; and safety, convenience and efficiency of design as regards to storage and handling. With certain types of aircraft, there are specific requirements that any add-on equipment must meet over and above any mission essential requirements. This becomes especially true when state-of-the-art electronics is incorporated into the package.

In one particular program, the aircraft that delivered the sonobuoys was well-suited to the type of mission desired. Accordingly, the launcher that would be used would have to mechanically and electrically connect into that particular aircraft's systems. The launcher had to be triggered either manually by a 15 volt, indefinite pulse or by an on-board computer and a 15 volt, 70 msec pulse, and it had to have compatible interlocking structure where it interfaced with the aircraft. It is also necessary to have such a launcher where only one buoy could be fired per launch pulse, although a plurality of buoys were carried simultaneously. Additionally, again because of the sensitive electronics involved and the launcher/aircraft physical configuration, it was necessary that no electro-explosive devices be used, and that whenever a buoy was launched, it would leave the launch container at at least 15 feet per second minimum velocity. Finally, due to space limitations, no external power source, such as batteries, would be used, i.e. the system would have to work off of only aircraft power.

SUMMARY OF THE INVENTION

It is therefore an object of the present invention to provide a multi-store launcher that will mechanically and electrically interface with existing transporting aircraft.

It is another object of the present invention to provide such a multi-store launcher that only receives launch signals and power from the transporting aircraft.

It is still another object of the present invention to provide such a multi-store launcher that carries electrical means to switch the launch signal to the next sequential store.

It is still a further object of the present invention to provide such a launcher with electrical means to prevent more than one store from being launched at a time.

These and other objects and advantages of the present invention are achieved by providing a tubular launch container filled sequentially with sonobuoys, or similar devices, that directly connects, electrically and mechanically, with an existing aircraft to allow an operator in the aircraft to control individual launches of the buoys. Individual compressed gas cartridges, activated by a spring-biased striker that is released upon failure of a burn-resistor, provide propulsion to an individual buoy to eject it at the proper velocity. An electrical circuit in the launcher, using a silicon controlled rectifier and a capacitor, controls power from the aircraft system and regulates and directs it to ensure a successful launch.

BRIEF DESCRIPTION OF THE DRAWINGS

FIG. 1 shows a perspective view, partially broken away, of the fuselage of an aircraft showing multiple chutes for carrying individual launch containers;

FIG. 3 shows a cross-sectional view near the discharge end of the launch container taken along lines III—III of FIG. 2.

DETAILED DESCRIPTION OF THE PREFERRED EMBODIMENT

Figure 2:
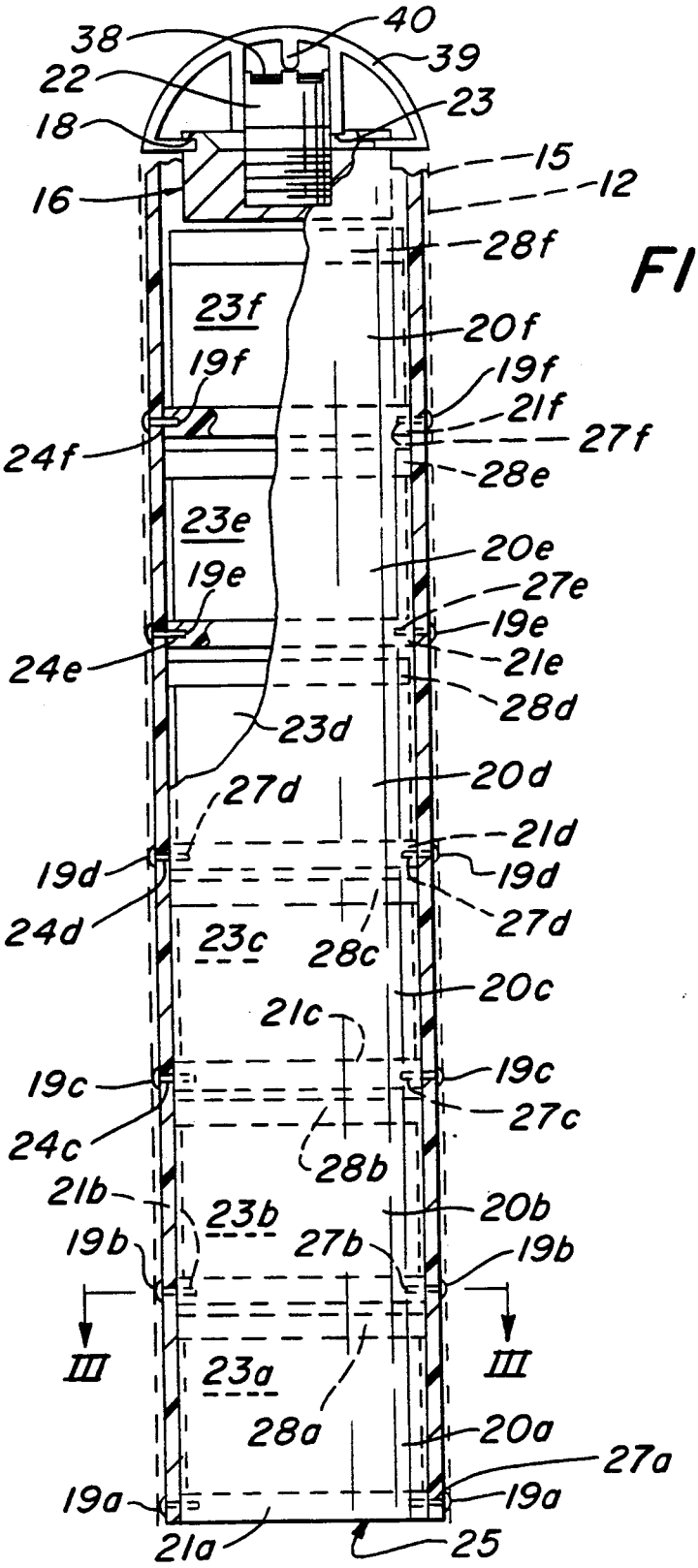
FIG. 2 shows a longitudinal view of an individual launch container with portions cutaway to diagramatically show the electrical circuitry on the inside of the launch container bore.

Referring now to the drawings, wherein like numerals refer to like parts, FIG. 1 shows a partially broken away perspective view of the fuselage of an aircraft 10 that can be used to carry and dispense stores, such as munitions or sonobuoys. These stores, such as sonobuoys 23*a–f*, are placed in launch containers 15 (as seen in FIG. 2) which are then packed, in the regular manner, into individual chutes 12 located in the belly 11 of the plane. FIG. 2 shows a longitudinal view of an individual launch container 15, with phantom lines for the inside walls of chute 12, having portions cutaway to show greater detail. Container 15 is a tubular shaped body with a breech end 16 and a discharge end 25 and can be made from any lightweight, but rigid, material such as ABS plastic or aluminum. Container 15 is snapped into fitting contact, through flange 18 at the breech end thereof, with the inner, dome-shaped structure 39 of chute 12 so that a thin contact plate 38 atop control module 22 rests inside receptacle 23 and touches aircraft power lead 40. Container 15 has a centrally-situated control module 22 removably inserted at its breech end and an integral wiring harness, composed of power lead 14 and return leads 17*a–f*, such as copper strips, running from module 22 to each of a plurality of launch assemblies 20*a–f*, respectively. Leads 17*a–f* and power lead 14 are bonded along the inner bore of container 15. As will be discussed, stores 20*a–f* are ejected through discharge end 25.

Each launch assembly 20*a–f* comprises a pressure plate 21*a–f*, each removeably secured by a pair of breakaway shear pins 19*a–f*, a store 23*a–f* and a gas generator and obturator package 28*a–f*. As shown more clearly in the cutaway portions of FIG. 2, a launch assembly is created by first inserting a gas generator and obturator package, a store and then a pressure plate held in place by pins 19. Each plate 21*a–f* can be made of a similar plastic material as container 15 and is made of sufficient thickness to accommodate the ends of pins 19*a–f*. Pins 19*a–f* are fastened through apertures 24*a*–24*f* in predetermined locations in the sides of container 15 and forced into smaller diameter holes 27 in matching locations in plates 21. Each plate 21 is made to a prespecified diameter that ensures a snug, airtight fit inside of container 15 that will withstand a greater pressure than pins 19*a–f*. Pins 19*a–f* are made with a defect therein, as is known, to guarantee that they will shear off when an appropriate predetermined pressure is applied.

FIG. 3 shows a cross-sectional plan view of container 15 taken along lines III—III of FIG. 2 showing the inside of gas generator and obturator package 28*a*. Packages 28*a*–28*f* can be made from a combination of ABS plastic shell 25 filled with polyurethane or other similar material to secure and cushion parts therein and are appropriately sized to fit snuggly inside container 15 with gas escape holes 57 cut through the bottom, as shown. Each package 28 comprises a source of compressed gas, such as gas cartridge 26, and an electromechanical firing mechanism 30. Cartridge 26 is securely held in place by a molded hollow indentation 29 in the wall of package 28 and a plastic receptacle 32. A thin metal hermetic seal 33 is placed over cartridge 26 to retain the pressurized gas therein, as is known in the art.

Mechanism 30 comprises a pivoting striker 35, rotatable on a predetermined pivot point 37, that has at one end, a sharp spike 39, and at the other end, a biasing means, such as helical tension spring 42 of predetermined strength. Striker 35 is restrained, initially, to the open position shown in full by a burn resistor 44, connecting ends of restraining wire 46. Wire 46 is connected into the firing circuitry, as will be explained, such that, on one end, a spring-mounted plunger 48, which is electrically connected by compression spring 51 to wire lead 53, maintains contact with a positive lead 14 and, on the other end, terminal 56 is connected via wire lead 59 to rivet 22 which is connected to SCR anode by by any of leads 17*a*–17*f*.

Figure 4:
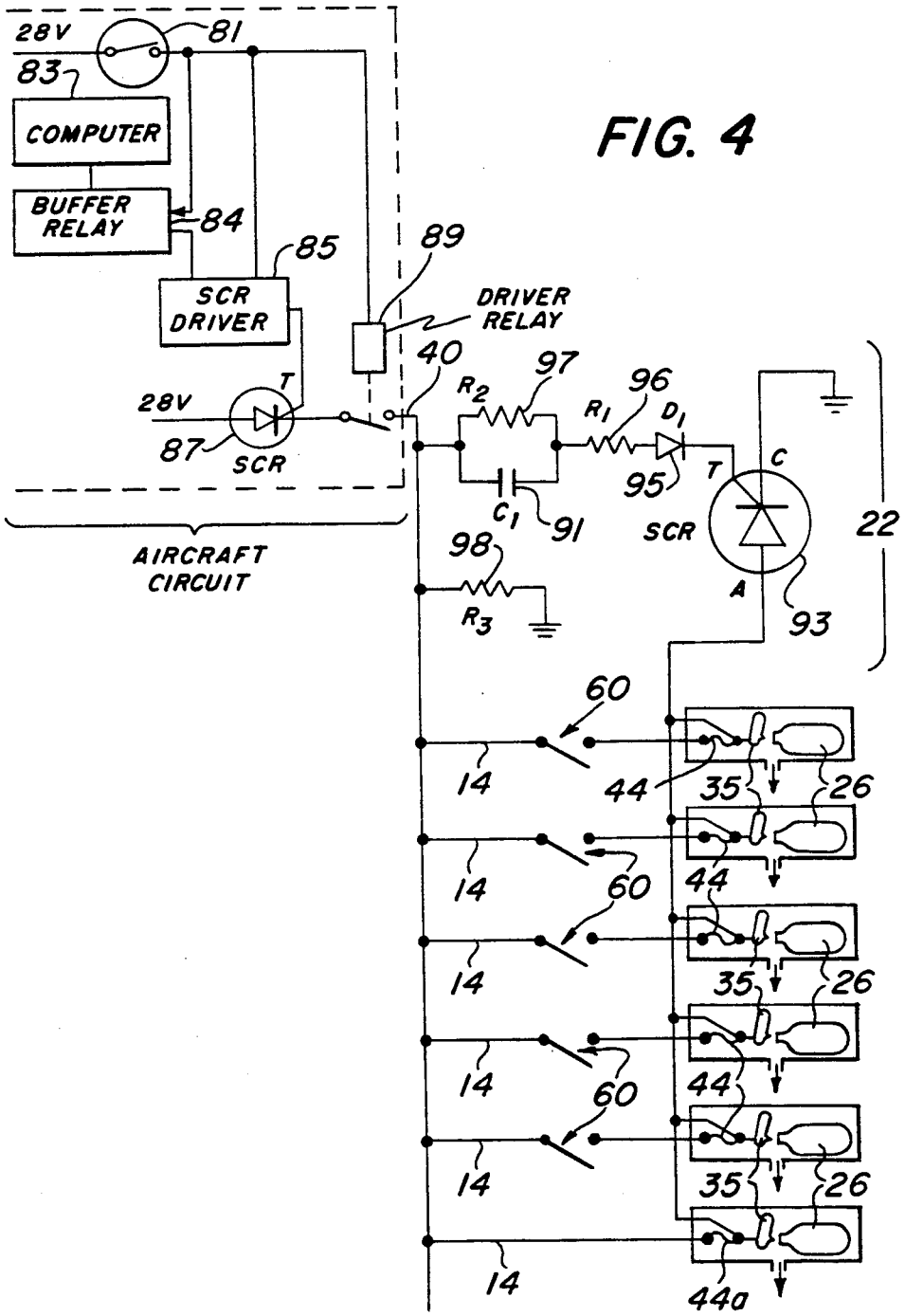
FIG. 4 shows a diagrammatic view of the electrical circuitry used to activate one of the launch containers.

FIG. 4 shows schematically the circuit used to sequentially fire a store, or buoy 23. The aircraft circuitry that provides the appropriate 28 volt signal at aircraft power lead 40 is surrounded by the dashed line and is essentially comprised of a combination of the manual (off-line) circuit and the computer-controlled (on-line) circuit, as shown. One of a plurality of launch chutes 12 can be chosen by either manual selection, from a spring-loaded, contact switch 81, or automatically, as by computer 83. Either signal is then fed through an SCR Driver 85 to SCR 87.

As seen in FIG. 4, the launch circuitry inside control module 22 consists principally of a blocking capacitor 91, a second SCR 93, a diode 95 that prevents transient signals from feeding back and resistors 96, 97 and 98. Resistor 96 acts to limit the current moving through the circuit; resistor 97 is a bleed resistor; and resistor 98 allows interrogation signals from the aircraft circuitry to determine if this particular chute is loaded with sonobuoys. One working circuit has a 2.0 uf capacitor 91, a 430 ohm resistor 96, a 51,000 ohm resistor 97 and a 10 ohm resistor 98. As the signal is sent to buoy 23*a* and resistor 44*a* fails, buoy 23*a* will be discharged. As buoy 23*a* leaves its space in launcher 15, a micro-switch 60 completes the circuit for the next store 23*b* such that the next pulse will cause burn resistor 44*b* to fail and so forth.

Operation

A plurality of buoys 23*a–f* are packed into each launch assembly 15 and, as each individual buoy is secured, normally-closed switch 60 is opened. Assemblies 15 are then secured into chutes 12. A buoy may be launched manually when an operator selects a chute 12 and depresses switch 81. Closing this switch applies 28 volts D.C. simultaneously to SCR Driver 85 and Driver relay 89. This signal will cause relay 89 to close, thereby completing the circuit to the chute selected (as at 40). SCR Driver 85, after a 50 ms delay, sends a short pulse to the SCR trigger and turns on SCR 87 applying 28 volts to the launcher. The delay insures that relay 89 is fully closed before the SCR turns on. SCR 87 will remain on as long as switch 81 is depressed; as soon as switch 81 opens, relay 89 will open and SCR 87 will turn off, thus stopping the signal. When buoy launch is in the automatic mode, computer 83 selects the chute and sends a firing pulse thru launch control buffer relay 84. At the proper time, relay 84 applies 28 volts to SCR Driver 85 and relay 89. Further sequence of operations is similar to the off-line mode, as described above, except that the pulse duration is limited to 70 ms, or some other computer preset value.

SCR 87 directs an appropriate pulse of power from the aircraft thru copper strip 14 to a predetermined burn resistor 44, causing it to fail. Burn resistor 44 can be either a standard 1 ohm carbon resistor or a composite of a small gauge nichrome wire coiled around a 30/1000 inch thick segment of Dacron TM cord. Once burn resistor 44 fails, two independent actions will happen: firstly, the spring tension in spring 42 will overcome restraining wire 46 allowing spike 39 to puncture seal 33 and release the compressed gas and also the failure of burn resistor 44 breaks the circuit to the mode of SCR 93, thus turning that SCR off. Capacitor 91 remains in a fully charged condition as long as an aircraft pulse is present and this precludes current from flowing to the trigger of SCR 93. In this way, SCR 93 cannot be turned on even though switch 60 is closed for the next store 23 to be fired. When the aircraft pulse is finally removed by relay 89 opening, capacitor 91 discharges thru resistors 97 and 98. With capacitor 91 discharged, SCR 93 is ready to be turned on again by the application of another firing pulse from the aircraft firing circuitry. Escaping gas from cartridge 26 forces buoy 23*a* to break shear pins 19*a* and eject at a predetermined rate, not less than 15 feet per second, along with plate 21*a*. As store 23*a* exits, the next switch 60 is allowed to close to complete the circuit to ready buoy 23*b* for discharge. Remaining buoys are discharged in like manner.

Finally, while the multi-store launcher has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

What we claim is:

1. An improved launch container for delivering sonobuoys over prespecified territory wherein said launch container is connected to receive power from a transporting craft and has a plurality of chambers, each containing a sonobuoy; a plurality of gas generation means, one each within one of said plurality of chambers; electrical circuitry leading from said transporting craft to each of said chambers and firing means connected to said circuitry and said gas generation means, the improvement comprising:

connecting a silicon controlled rectifier to said circuitry to direct power from the transporting craft to the next sequential sonobuoy to be launched; and connecting a current blocking means to said circuitry to prevent the launching of more than one sonobuoy per pulse of power from the transporting craft.

2. An improved launch container for delivering sonobuoys over prespecified territory wherein said launch container is connected to receive power from a transporting craft and has a plurality of chambers, each containing a sonobuoy; a plurality of gas generation means, one each within one of said plurality of chambers; electrical circuitry leading from a transporting craft to each of said chambers and firing means connected to said circuitry and said gas generation means, the improvement comprising:

connecting a silicon controlled rectifier to said circuitry to direct power from the transporting craft to the next sequential sonobuoy to be launched; and connecting a capacitor to said circuitry to block current and to prevent the launching of more than one sonobuoy per pulse of power from the transporting craft.

3. An improved launch container for delivering sonobuoys over prespecified territory wherein said launch container is connected to receive power from a transporting craft and has a plurality of chambers, each containing a sonobuoy; a plurality of gas generation means, one each within one of said plurality of chambers; electrical circuitry leading from a transporting craft to each of said chambers and firing means connected to said circuitry and said gas generation means, the improvement comprising:

connecting a current switching means to said circuitry to direct power from the transporting craft to the next sequential sonobuoy to be launched;

connecting a current blocking means to said circuitry to prevent the launching of more than one sonobuoy per pulse of power from the transporting craft; and including a burn resistor connected to said gas generating means.

4. An improved launch container for delivering sonobuoys over prespecified territory wherein said launch container is connected to receive power from a transporting craft and has a plurality of chambers, each containing a sonobuoy; a plurality of gas generation means, one each within one of said plurality of chambers; electrical circuitry leading from a transporting craft to each of said chambers and firing means connected to said circuitry and said gas generation means, the improvement comprising:

connecting a current switching means to said circuitry to direct power from the transporting craft to the next sequential sonobuoy to be launched;

connecting a current blocking means to said circuitry to prevent the launching of more than one sonobuoy per pulse of power from the transporting craft; and wherein said gas generation means includes a disc holding a source of compressed gas and a spring-biased striker arm pivotable thereon to release the gas with gas communicating holes therethrough.

* * * * *